US007062940B2

(12) United States Patent
Huynh

(10) Patent No.: US 7,062,940 B2
(45) Date of Patent: Jun. 20, 2006

(54) CARVED PEARL

(75) Inventor: Chi Huynh, 548 W. Bonita Ave., San Dimas, CA (US) 91773

(73) Assignee: Chi Huynh, San Dimas, CA (US)

( * ) Notice: Subject to any disclaimer, the term of this patent is extended or adjusted under 35 U.S.C. 154(b) by 123 days.

(21) Appl. No.: 10/318,986

(22) Filed: Dec. 13, 2002

(65) Prior Publication Data

US 2004/0112086 A1 Jun. 17, 2004

(51) Int. Cl.
*A44C 17/00* (2006.01)
*A44C 25/00* (2006.01)

(52) U.S. Cl. ..... 63/36; 63/32; 63/28; 119/244

(58) Field of Classification Search ..... 63/36, 63/35, 38, 32; 119/244; 428/67
See application file for complete search history.

(56) References Cited

U.S. PATENT DOCUMENTS

| | | | | |
|---|---|---|---|---|
| 988,889 | A | 4/1911 | Mikimoto | |
| 2,261,958 | A | 11/1941 | Burri | |
| 3,835,665 | A | 9/1974 | Kitchel | |
| 3,871,333 | A | 3/1975 | Gotoh | |
| 4,081,972 | A | 4/1978 | Kotlar | |
| 4,292,715 | A | 10/1981 | Huddon | |
| 4,708,001 | A * | 11/1987 | Alburger | 63/32 |
| 4,783,975 | A * | 11/1988 | Komatsu et al. | 63/32 |
| 4,809,417 | A | 3/1989 | Normann, Jr. | |
| 4,954,340 | A | 9/1990 | Maeda et al. | |
| 5,347,951 | A * | 9/1994 | Fankboner | 119/244 |
| 5,480,844 | A | 1/1996 | Matsui et al. | |
| 5,749,319 | A | 5/1998 | Hirose | |
| 5,853,826 | A | 12/1998 | Starcke et al. | |
| 5,882,786 | A | 3/1999 | Nassau et al. | |
| 6,053,009 | A | 4/2000 | Broggian | |
| 6,056,624 | A * | 5/2000 | Fildan | 450/1 |
| 6,146,723 | A | 11/2000 | Arends | |
| 6,341,580 | B1 | 1/2002 | Langdon | |
| 6,381,985 | B1 | 5/2002 | Burgard | |
| 6,412,304 | B1 | 7/2002 | Adelman | |
| 6,499,314 | B1 | 12/2002 | Weinmann et al. | |
| 2002/0117486 | A1 | 8/2002 | Christensen | |

FOREIGN PATENT DOCUMENTS

| | | | |
|---|---|---|---|
| EP | 1 084 615 | | 3/2001 |
| JP | 2174621 | A * | 7/1990 |
| JP | 406046712 | A * | 2/1994 |
| JP | 10279397 | | 10/1998 |

(Continued)

OTHER PUBLICATIONS

Buchard Galleries Inc, "Partial Auction Results—Dec. 10, 2000" providing pp. 1-3 and photograph, 4 pages, from www.burchardgalleries.com/auctions/2000/dec1000/dec1000r.htm. Item 35E on p. 3 is shown in the photograph.*

(Continued)

*Primary Examiner*—Katherine Mitchell
(74) *Attorney, Agent, or Firm*—Raymond Wagenknecht; David R. Preston & Associates

(57) ABSTRACT

A pearl including a nucleus optionally including a gem and a nacre coating. The nacre coating partially coats but does not fully coat the nucleus thereby exposing at least a portion of the nucleus.

17 Claims, 4 Drawing Sheets

FOREIGN PATENT DOCUMENTS

| | | | |
|---|---|---|---|
| JP | 2002101929 | | 4/2002 |
| WO | 89/02919 | | 4/1989 |
| WO | WO 00/13540 | * | 3/2000 |

OTHER PUBLICATIONS

"June Birthstone: The Pearl Birthstone" from www.thepearlguide.com/junebirthstone.com, 2 pages, undated.*

"Anniversary Ideas and Birthstones" from www.cwjewelers.com/anniversary.html, 3 pages plus 1 page from webarchive.org documenting posting date of Aug. 3, 2001 or earlier.* www.jewelrymall.com, "Coral", 3 pages, downloaded from www.jewelrymall.com/stones/coral.html, © 1995-1999, especially p. 2.* www.bernardine.com, Bernardine fine art jewelty, "Red Gemstones", 4 pages, downloaded from www.bernardine.com/gemstones/red.htm, especially p. 3, undated.*

Buchard Galleries Inc, "Partial Auction Results—Dec. 10, 2000" providing pp. 1-3 and photograph 2 pages, total 5 pages, from www.burchardgalleries.com/auctions/2000/dec1000/dec1000r.htm. Item 35E and 35D on p. 3 is shown in the photographs.*

ABC News "Perils of Pearl Buying"undated, 4 pages, downloaded from www.abcnews.go.com/sections/GMA/GoodMorningAmerica/GMA020212Pearl_investigation html, esp. p. 3 "Tips for Pearl Buyers".*

Jerry Smith "Freshwater Pearls versus Saltwater Pearls", undated jsbeads, downloaded from www.jsbeads.com/Fresh-eeater-pearls/saltwater-freshwater.asp, 3 pages.*

Lot 1137: 11 mm Tahitian Carved Pearl Pendant, 1 page, undated, from www.liveauctioneers.com/auctions/ebay/280289.html.*

Pearls Inventory Item 655214, 14K 9 mm Tahitian carved Pearl earrings, 2 page, undated, downloaded from www.jewelersweb.com/inventoryitem.php?itemnumber=655214.*

Pearls Inventory Item 695321, 14K 11 mm Tahitian carved Pearl pendant, 2 page, undated, downloaded from www.jewelersweb.com/inventoryitem.php?itemnumber=695321.*

Search results for "carved pearl", 2 pages, undated, downloaded from www.jewelersweb.com/index.php?page=searchinv.*

Foredom Power Tools and Accessories introductory pages and accessories catalog, http://www.foredom.com.

Foredom Power Tools Series TX introductory page and owner's manual for Series Tx, http://www.foredom.com.

Foredom Power Tools Series CC introductory page and owner's manual for Series CC, DD, MM, S, SB, SM, SR, SRB, SRM, http://www.foredom.com.

Foredom Power Tools owner's manual for PowerGraver, http://www.foredom.com.

* cited by examiner

CARVED PEARL

TECHNICAL FIELD

The present invention relates generally to methods of producing pearls and the pearls obtained from these methods. More specifically the present invention relates to a cultured pearl having a partially exposed nucleus, referred to as a carved pearl, optionally including a gem and methods of production.

BACKGROUND

A pearl results from a mollusk's natural defense against a foreign particle and is formed by isolating the particle within a hardened secretion referred to as a nacre. The particle acts as an irritant and stimulates secretion of the viscous substance which hardens into the nacre coating. The desirability of pearls has lead to their widespread cultivation within a variety of mollusks. Among these *Pinctada fucata, Pinctada maxima, Pictanda margaritifera* have become some of the more popular sources for pearl production however mollusks such as abalone, conch and others are also currently used to produce highly sought after pearls.

Because of the desirability of pearls, multiple procedures have been developed to produce superior pearls for the jewelry industry. These techniques primarily involve incubating within a mollusk a nucleus constructed from shell powder or other non-precious material. A technology disclosed in U.S. Pat. No. 4,783,975 has taken this one step further by producing a colored pearl. This technology involves incubating within a mollusk waste shell material with an inorganic dye as a nucleus. Although a variety of single colors may be produced, this technique is limited to a single colored pearl and does not incorporate an exposed nucleus or carving.

Alternative technologies have been developed to produce pearls having unusual characteristics. For example, WO 00/13540 describes a process where an inlay is physically inserted into a cultured pearl. This process requires obtaining a pearl, removing a surface groove from the nacre coating such that an inlay element may be placed generally along the surface of the nacre coating, and anchoring the inlay within the groove. However because the inlay element is inserted after the pearl is produced, this technique is limited to a pearl that exposes the entire outer surface of the inlay element and is limited by the shape of the inlay element.

Decorating the surface of a pearl has been disclosed in Japanese patent publication #2002101921. This technique involves obtaining a pearl, engraving a surface groove along the nacre coating and affixing a decorative material such as a pigment or gold dust in the groove. Excess material is removed from the outer pearl surface and a coating such as a clear resin is applied. However this method does not provide for an exposed nucleus and is limited to materials that may be inserted into a surface groove.

SUMMARY

The present invention addresses these problems and provides related benefits. The present invention includes a pearl having a nucleus and a nacre coating. The nacre coating partially coats but does not fully coat the nucleus allowing exposure of at least a portion of the nucleus. The present invention also includes a method of producing a carved pearl including: inserting a nucleus into a mollusk able to produce a pearl, incubating the nucleus within the mollusk thereby allowing the mollusk to coat the nucleus with a nacre coating and removing a portion of the nacre coating which exposes a portion of the nucleus.

BRIEF DESCRIPTION OF THE DRAWINGS

FIG. 2A depicts a nucleus 11 having a single gem, FIG. 2B depicts a nucleus 11 having two gems affixed together; and FIG. 2C depicts a nucleus 11 including a cluster of gems.

DEFINITIONS

Figure 1:
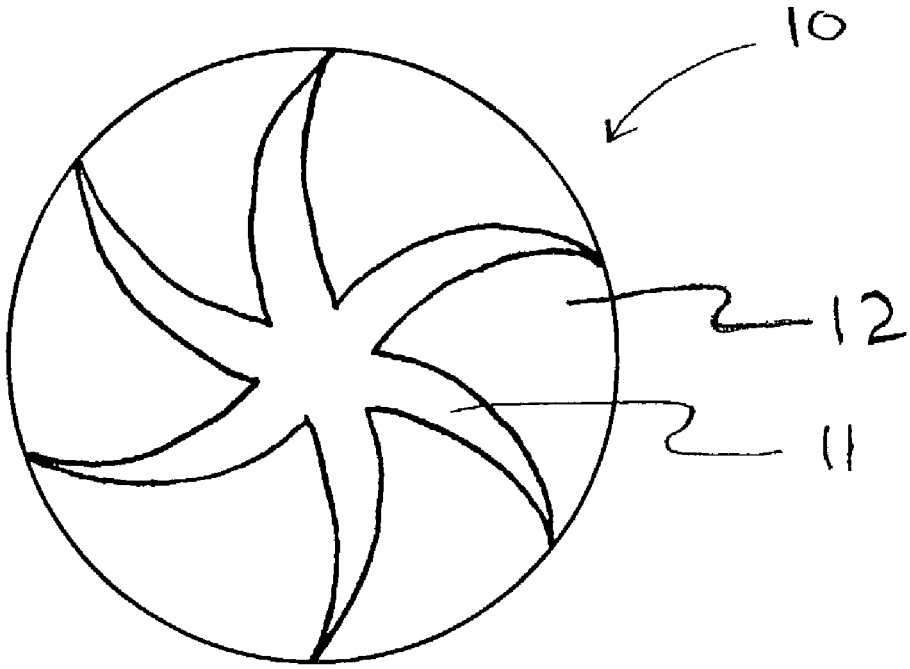
FIG. 1 depicts a carved pearl 10 of the present invention having a nucleus 11 partially exposed through a carved nacre coating 12.

Unless defined otherwise, all technical and scientific terms used herein have the same meaning as commonly understood by one of ordinary skill in the art to which this invention belongs and to those referred to in the specification. Generally, the nomenclature used herein and the manufacture or laboratory procedures described below are well known and commonly employed in the art. Conventional methods are used for these procedures, such as those provided in the art and various general references. Where a term is provided in the singular, the inventor also contemplates the plural of that term. The nomenclature used herein and the laboratory procedures described below are those well known and commonly employed in the art.

DETAILED DESCRIPTION OF THE PREFERRED EMBODIMENTS

The present invention recognizes a pearl may be produced having qualities unlike those found in nature. The present invention provides such a pearl, referred to as a carved pearl 10, and methods of producing a carved pearl. The present invention incorporates by reference each document setforth above and below in its entirety.

As a non-limiting introduction to the breath of the present invention, the present invention includes several general and useful aspects, including:

1. a pearl having a nucleus 11 and a nacre coating 12 where the nacre coating 12 partially coats but does not fully coat the nucleus 11 thereby exposing at least a portion of the nucleus 11; and
2. a method of producing a carved pearl 10 including inserting a nucleus 11 into a mollusk able to produce a pearl, incubating the nucleus within the mollusk such that the mollusk deposits a nacre coating 12 about the nucleus 11, and removing a portion of the nacre coating 12 thereby exposing a portion of the nucleus 11.

The Pearl

The pearl of the present invention is a cultured pearl having a partially exposed nucleus 11. As will become apparent, a carved pearl 10 may be constructed from any pearl. The choice of pearl may be performed in part by choosing the type of mollusk in which to incubate the nucleus 11. For example if a mabe pearl is desired the appropriate mollusk would be an abalone. As is apparent from the present invention pearl oysters and mollusks such as conchs are additional non-limiting examples of mollusks that may also be utilized to produce a carved pearl 10.

The present invention envisions multiple shapes for the carved pearl 10. The pearl may be a traditional shape such as generally spherical or dome shaped or may have a modem shape such as but not limited to a tear drop, a cross, a heart, a star, a triangle and the like. The shape of the pearl may be formed in part by but not limited to the physical characteristics of the nucleus 11 incubated within the mollusk, the physical characteristics of the mollusk and post incubation manipulation of the cultured pearl such as but not limited to shaping, engraving or carving. Absent pretreatment of the nucleus 11, which may selectively reduce or inhibit the formation of the nacre, a mollusk will generally lay an even nacre coating 12 about the nucleus 11. Therefore a generally spherical nucleus 11 will often result in a generally spherical pearl. However by altering the shape of the nucleus 11 or by using a non-spherical nucleus 11, the shape of the pearl may also be altered from the traditional spherical shape. Altering the shape of the nucleus 11 prior to incubation may include procedures such as removing a portion of a nucleus 11 or adding at least one secondary structure.

Secondary structures may be any structure known in the art such as but not limited to a polymer and shell material that will not prevent pearl production in a pearl producing mollusk however the present invention recognizes pearl production may be enhanced or reduced by the addition of a secondary structure. The shape of an appropriate secondary structure depends in part on the pearl shape desired. For example a cross-shaped pearl may be obtained by incubating a nucleus 11 having two rod-like structures positioned generally perpendicular to one another. As another example, inserting a rod-like structure between two nuclei and incubating the resulting nucleus 11 within a mollusk may produce a heart-shaped or dumbbell-shaped pearl. As a third example, incubating a nucleus 11 with approximately five spherical structures positioned about a central structure may produce a star-shaped pearl. The present invention recognizes that obtaining modern shapes such as but not limited those setforth above, may include post incubation manipulation of the pearl such as trimming, cutting or surface carving the nacre coating 12 to obtain the desired pearl shape.

Nucleus

The nucleus 11 acts as an irritant to begin pearl formation and provides a seed in which a mollusk lays a nacre coating 12 during incubation or cultivation. The nucleus 11 may be prepared from any material that does not prevent pearl formation in a mollusk able to produce a pearl. For example, a nucleus 11 must be significantly nontoxic to prevent killing the mollusk and must be limited in size thereby allowing the pearl to form within the mollusk. Although the size of a nucleus 11 may vary depending on the size or type of mollusk, as a general guideline a nucleus 11 may have a diameter from about three millimeters to about twenty-five millimeters or from about five millimeters to about twenty millimeters. Moreover, the size of the nucleus 11 may also depend on the carving desired. The nucleus 11 should be sufficiently large that at least a portion of the nucleus 11 may be visible through a carving, however the nucleus 11 need not be easily observable.

Preferably the nucleus 11 includes at least one gem 13 however this does not have to be the case. A nucleus 11 may be constructed from materials such as but not limited to a metal, a metal alloy, a wood, a resin, a polymer, a glass, a colored glass, a cubic zirconia and the like. Materials that may be particularly desired are those that are particularly desired in the jewelry industry such as but not limited to gold and silver however the present invention also envisions less traditional materials used alone or in combination with these traditional materials. Materials may be screened for their applicability with the present invention by testing their toxicity and pearl production capability. Toxicity and pearl production may be tested by inserting the material in a mollusk able to produce a pearl, incubating the mollusk in conditions suitable to form a pearl, and examining the resulting pearl. This process may further include carving the nacre coating 12 thereby exposing at least a portion of the nucleus 11 and examining the resulting carved pearl 10. The present invention also encompasses a carved pearl 10 formed from a nucleus 11 including materials that will not result in a pearl in a naturally occurring mollusk but will result in a pearl from a mollusk that has been altered from its natural state such as by using current molecular biology and biochemistry techniques or by using unique culture conditions and the like.

Figure 2A:
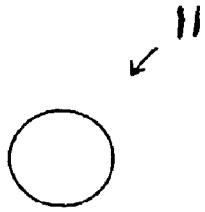
FIGS. 2A–2C depict various nuclei 11 of the present invention.
Figure 2B:
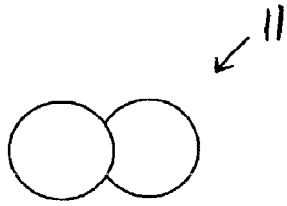

Referring to FIG. 2A, the nucleus 11 may be formed from a single gem 13 as a nucleus 11. The single gem 13 is incubated within the mollusk and the resulting pearl is carved to expose at least a portion of the single gem 13. Alternatively and referring to FIGS. 2B and 2C, the nucleus 11 may include at least two gems 13. When producing a pearl having a nucleus 11 that includes at least two gems 13, preferably the pearl is carved to expose each of the at least two gems 13 however one may wish to only expose a portion of one or less than each of the at least two gems 13.

Figure 2C:
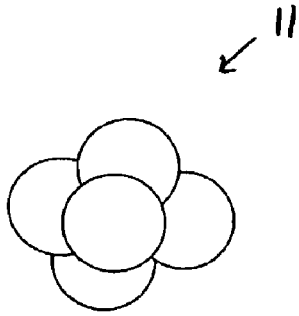

When a nucleus 11 includes two or more gems 13, the gems 13 may be affixed together prior to insertion into the mollusk or may be inserted without affixing the gems 13. Gems 13 may be affixed in any configuration such as but not limited to side-by-side, front-to-back, top-to-bottom, or a cluster. The term "cluster" refers to a nucleus 11 that includes a group of at least three individual components such as but not limited to three gems 13 and is not meant to be limited to a specific arrangement. FIG. 2C is a non-limiting example of a nucleus 11 having a cluster arrangement. Moreover at least one of the gems 13 may be affixed to a secondary structure. A secondary structure may be affixed on the perimeter of the nucleus 11 or may be affixed generally within a nucleus 11 thereby spacing at least two gems 13 from one another. Any affixing technique known to those skilled in the art may be used to affix at least two gems 13 together such as adhesively bonding two gems 13 together with a jeweler's adhesive so long as the affixing technique does not poison the mollusk sufficiently to prevent pearl formation.

The Gem

The present invention envisions multiple gems 13 may be used with the present invention such as but not limited to an agate, an alexandrite, an amber, an ametrine, an amethyst, an aquamarine, an apatile, a beryl, a bloodstone, a chrysoberyl or cat-eye, a citrine, a corundum, a chalcedony, a chysocolla, a coral, a diamond, an emerald, a green beryl, a garnet, a quartz, a lolite, a jadcite, a kupzite, a lapis lazuli, a moonstone, a malachite, a moamite, an onyx, an opal, a peridot, a red corundum, a ruby, a sardonyx, a sapphire, a spessartime, a sphene, a spinel, a star ruby and sapphire, a sunstone, a tanzanite, a tiger eye, a tourmaline, a topaz, a turquoise, a tsavorite, and a zircon. A gem 13 offers reflective characteristics not found in traditional nuclei. The proper gem 13 may be chosen according to the desired end product. If a single colored carving is desired, a nucleus 11 having a single type gem 13 may be incubated within the mollusk. For example a pearl having a green carving may be obtained by carving a pearl having an emerald nucleus 11. If a multicolored carving is desired, a nucleus 11 having at least two different gems 13 may be incorporated into a nucleus 11. For example, a pearl representing the United States or the United States flag may have a nucleus 11 including red and blue corundums incased in a white pearl. Alternatively the nucleus 11 may incorporate red and blue corundums with a diamond. The diamonds in this embodiment may generally represent white, white strips or stars in the United States flag. Additional motifs to inspire an arrangement of gems 13 within a nucleus 11 may take into account the zodiac sign for one's birthday, the color of a flag such as a state flag, a province flag, a city flag or a club or organization's flag, a holiday color scheme such as the orange and black of Halloween, the red and green of Christmas or the red of Valentine's Day.

Nacre Coating

The present invention includes a nucleus 11 that is partially coated by nacre 12. Although a mollusk will generally deposit the nacre coating 12 about the entire nucleus 11, the end product will be less than fully coated allowing exposure of at least a portion of the nucleus 11. Preferably a mollusk is permitted to fully encase the nucleus 11 then a portion of the nacre 12 is removed such as by carving.

As a general guideline, mollusks naturally coat foreign material at rate of about 0.5 millimeters of thickness per year however results may vary. Therefore by altering the incubation time, the thickness of the nacre coating 12 may be partially controlled. The present invention encompasses the range of nacre coatings 12 that may be produced naturally by a mollusk and those that take advantage of technologies that enhance the thickness and quality of a nacre coating 12. Multiple methods of altering nacre coatings 12 and its production rate have been discovered and disclosed in previous documents. For example U.S. Pat. No. 4,954,340 discloses a method to stimulate hemocytes along the wound site incurred by insertion of a nucleus 11 by providing a mitogen and optionally an adjuvant and will have further applications with the present invention and is incorporated by reference in its entirety. U.S. Pat. No. 6,341,580 discloses a nucleus 11 for the production of half pearls or mabe pearls in mollusks and may also be used with the present invention in producing a pearl which can later be carved and is incorporated by reference in its entirety. PCT International Publication No. WO 89/02919 discloses an in vitro method for cultivation of pearls and may be utilized as a method of producing a pearl to be carved and is herein incorporated by reference in its entirety.

Carved Region

The present invention includes a nucleus 11 at least partially exposed through the nacre coating 12. Exposing the nucleus 11 generally occurs by removal of a portion of the nacre coating 12, also referred to as carving the nacre coating 12. The carved portion may be any shape and any size able to be carved on a pearl. Shapes such as a letter, a number, a symbol or any combination thereof may be desirable however this is not an exhaustive list of desired shapes. For example, monograms are frequently desired and are examples of letters encompassed by the present invention. Moreover the present invention recognizes that different languages having different symbols representing initials, names, letters and words and are therefore also encompassed by the present invention. Symbols such as but not limited to a peace sign, facial expression, and a trademark may also be carved on a pearl however this is not an exhaustive list.

The size of the carved region must be smaller than that of the pearl such that there remains at least a portion of the nacre coating 12 on the nucleus 11. The size among carvings may be the same or different depending on the individual's requirements or desires. For example, a necklace may be constructed from a series of pearls having the same or nearly the same carving shape and size. However an article of manufacture such as a pin may incorporate carved pearls 10 having multiple carving sizes and shapes. Although at least one carving exposes a portion of the nucleus 11, the present invention also encompasses engravings, or surface carvings, in the nacre coating 12 not exposing the nucleus 11 in combination with a carving. For example a method and system for laser marking a gemstone has been disclosed in U.S. patent application Ser. No. 2002/0117486 and will have related benefits with the present invention and is herein incorporated by reference in its entirety.

Articles of Manufacture Incorporating a Carved Pearl

The present invention also encompasses articles of manufacture incorporating a carved pearl 10. Some examples of articles of manufacture that may incorporate a pearl are personal items such as jewelry and clothing as well as nonpersonal items such as items associated with a business.

Figure 3:
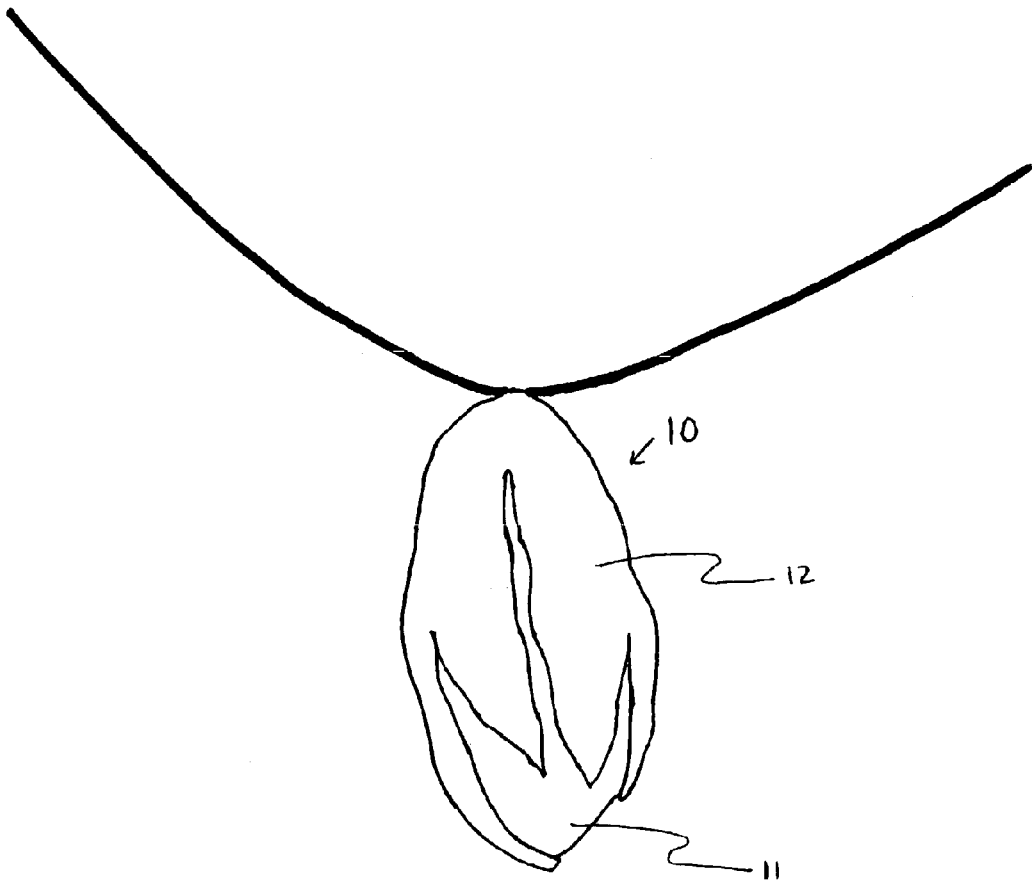
FIG. 3 depicts a carved pearl 10 used as a pendant and having a carved nacre coating 12 partially exposing a nucleus 11 formed from a single gem.
Figure 4:
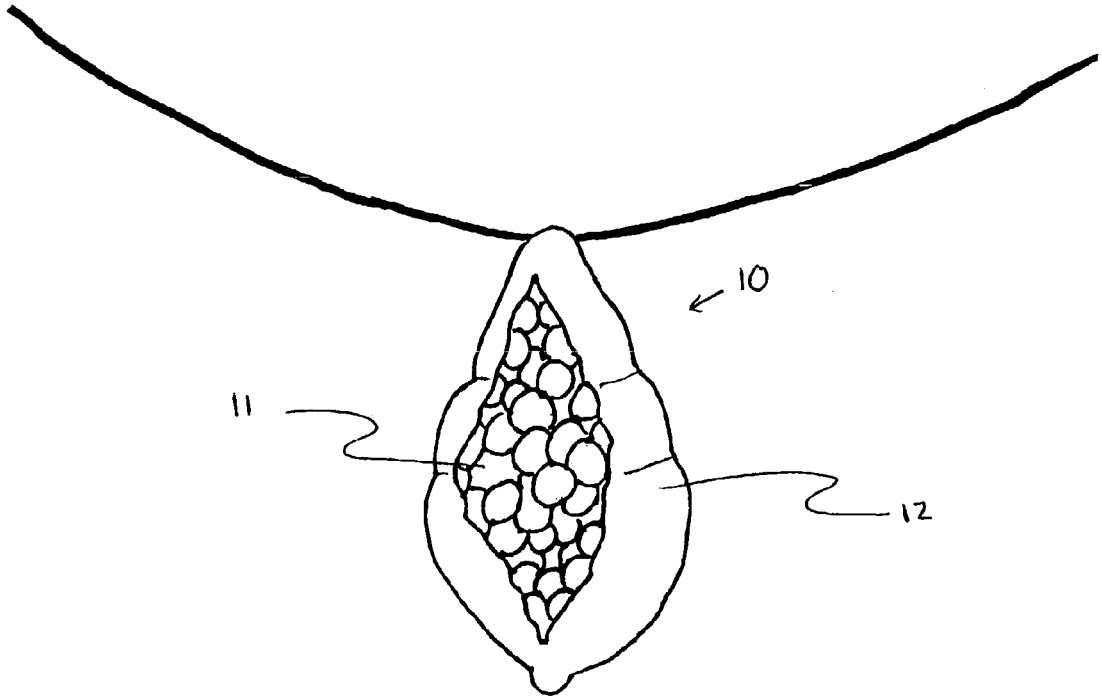
FIG. 4 depicts a carved pearl 10 used as a pendant and having a carved nacre coating partially exposing a nucleus 11 fonned from a cluster of gems.

In one embodiment a carved pearl 10 is used in combination with an article of manufacture such as an item of jewelry. Jewelry items useable with the present invention include but are not limited to a necklace, a ring, a pendant, an earring, a belly ring, a tie tack, a watch and a cuff link. As non-limiting examples, FIG. 3 demonstrates a pendant including a carved pearl 10 having a single nucleus 11 and FIG. 4 demonstrates a pendant including a carved pearl 10 having a cluster-like nucleus 11. Preferably the jewelry item displays the carved pearl 10 such that the exposed portion of the nucleus 11 may be observed however the present invention recognizes that at times the exposed portion of the nucleus 11 may not be observed.

In other embodiments, the carved pearl 10 can be incorporated in an article of clothing such as a top, a bottom or a clothing accessory. For example, a carved pearl 10 may be affixed to an object such as but not limited to a jacket, a coat, a shirt, a blouse, a skirt, pants, an undergarment, a shoe or sandal, a hat, a purse, a hair clip, a wallet, glasses or a money clip and the like.

Attaching a carved pearl 10 to an article of manufacture may be any technique known to those skilled in the art of the particular article of manufacture or the jewelry industry such as current mounting procedures. For example, attaching a carved pearl 10 may include but is not limited to drilling a hole or aperture through the pearl or adhesively attaching the pearl to a surface. Drilling hole into or through a carved pearl 10 may be preferred when an item such as a string, a pin, or a chain is used to link the pearl to the desired article of manufacture. For example, a carved pearl 10 necklace may be constructed by drilling a hole through each of the carved pearls 10 to be included in the necklace then sequentially inserting a string through each of the holes. It may be desirable when a series of carved pearls 10 are incorporated in this fashion and the nucleus 11 includes a gem 13, the hole or aperture does not extend through the gem 13 however this does not have to be the case. Preferably the hole or aperture travels nearby or adjacent to the gem 13 and may include drilling through a secondary structure incorporated in the nucleus 11. Alternative attachment techniques such as the joining techniques disclosed in U.S. Pat. Nos. 6,053,009 and 6,412,304 may also be performed with a carved pearl 10 and are incorporated herein by reference in their entirety. However, the present invention also encompasses a hole drilled through a gem 13. When drilling through a gem 13 or a nucleus 11 including a highly dense structure a drill bit with greater strength may be required. Such drill bits may be found in the in diamond cutting industry and the like. Alternatively a laser may be used to cut a hole or aperture into or through a carved pearl 10. In another embodiment the carved pearl 10 is adhesively affixed to a surface. Preferably the carved portion is not adhesively affixed to the surface such that the exposed nucleus 11 may be observed.

Method of Producing a Carved Pearl

The present invention encompasses a method of producing a carved pearl 10 including inserting a nucleus 11 into a mollusk able to produce a pearl, incubating the nucleus 11 within the mollusk, and removing a portion of the nacre coating 12 thereby exposing a portion of the nucleus 11. The method may optionally include the nucleus 11 including a gem 13, the pretreatment of the nucleus 11 or a portion of the nucleus 11, pretreatment of the mollusk, and may include cleaning, polishing or tumbling the pearl prior to or after carving.

Optional Pretreatment of the Nucleus

The present invention recognizes that it may be desirable to pretreat the nucleus 11 prior to insertion into the mollusk to alter the rate of the nacre coating 12 or to add additional features to a carved pearl 10. Multiple methods have been disclosed to increase and alter the rate of pearl formation. The present invention recognizes these and other techniques as useful in the formation of a nacre coating 12 about a nucleus 11 when producing a carved pearl 10. For example, a light scratching of a smooth surface may assist in attachment of the nacre coating 12 to the nucleus 11. Alternatively a coating such as a polymer or a coating including shell powder may further assist in the initial adherence of the nacre to the nucleus 11.

Additional features may be added to a carved pearl 10 by pretreating the nucleus 11. For example a nucleus 11 coating may further include an inorganic dye to alter the color of the pearl or to add an intermediate layer that is the same or different than the color of the portion of the nucleus 11 to be exposed. U.S. Pat. No. 4,783,975 discloses the use of an inorganic dye to produce a colored pearl and is incorporated by reference in its entirety. When adding an intermediate coating, a carved pearl 10 having a desired layered arrangement may be achieved by carving a large outer shape through the nacre coating 12 exposing the intermediate layer then carving a smaller inner shape exposing a portion of the nucleus 11. Additionally a single sized carved shape may expose multiple layers of the pearl. Moreover an intermediate coating may provide an added feature such as differing hues of color when the pearl is tilted or not tilted. U.S. Pat. No. 5,853,826 discloses a method of coating a gemstone with a material so the body of the gemstone appears to have a different color and may be applied to coating a nucleus 11 of the present invention and is herein incorporated by reference in its entirety.

Insertion of the Nucleus

Insertion of the nucleus 11 may be by any technique known to those skilled in the art of pearl production. Insertion generally involves partially opening a mollusk able to produce a pearl and inserting the nucleus 11 into the mollusk. The nucleus 11 may be inserted by injecting a nucleus 11 through a partially opened mollusk using a syringe having a needle gauge or aperture gauge greater than the diameter of the nucleus 11 or may be inserted by physically placing the nucleus 11 within the mollusk such as by using forceps. Alternatively, insertion may be by perforating a hole in the mollusk's shell, depositing the nucleus 11, and covering the hole with a bonding agent as discussed in U.S. Pat. Nos. 3,871,333 and 5,347,951 which are incorporated by reference in their entirety.

Incubation of the Nucleus

After insertion, the mollusk is incubated to allow the nacre coating 12 to form about the nucleus 11. The incubation time may vary according to the mollusk and the culture conditions. As a general guideline the nacre coating 12 occurs at about 0.5 millimeters per year however this may vary. The preferred thickness of the nacre coating 12 post incubation and pre-carving is from about 0.2 millimeters thick to about 1.5 millimeters thick. Using the provided general guideline, this may require an incubation step from about six months to about eighteen months however results may vary.

Carving the Pearl

Once the desired thickness is obtained, the pearl is removed from the mollusk and a portion of the nacre coating 12 is removed exposing a portion of the nucleus 11. Removal of the nacre coating 12 may be performed using a variety of cutting and sanding tools known in the mechanical and jewelry arts such as but not limited to bladed instruments, a drill or a laser. The removal may be by hand or may incorporate automated assistance to allow a high throughput approach or to ensure greater homogeneity among carved pearls 10. To assist in carving, the pearl may be immobilize such as by grasping the pearl with an appropriate holder, gluing the pearl to a wood stick, or grasping the pearl between the carver's fingers. Moreover, it may be desirable to draw the shape to be removed from the pearl as guidance. Drawing a region to be removed may be performed using a fine point permanent marker and the like.

In one preferred embodiment a pearl is carved using at least one bladed instrument. A bladed instrument may have knife-like or a bur-like cutting surface and should be sufficiently strong that it can remove at least a portion of the nacre coating 12. A variety of tungsten carbide burs and cutting burs are known in the cutting arts and are useable with the present invention. Examples of such bladed instruments are, but not limited to a round bur, a hard bur, an inverted cone, a bud bur, a cylinder, a cone bur, a saw bur, a knife-edge bur, a reamer bur, a wheel bur, a diamond cutting wheel, and a diamond bur. The appropriate bladed instrument may vary depending on factors such as but not limited to the amount or region of the nacre coating 12 to be removed. Generally, a cutting bur that has the same curve and shape of the desired carving is preferred. Bladed instruments are available through a variety of suppliers such as Advantage and Foredom® (Bethel, Conn.). The Foredom® flexible shaft power tools may be particularly useful with the present invention as they are commonly used in the jewelry industry for engraving and have a wide variety of burs and power tools.

Carving a pearl with a bladed instrument is generally performed using a series of rough cuts followed by a series of smoothing or refining cuts however the present invention envisions a single cut may expose a portion of the nucleus 11 thereby producing a carved pearl 10. These initial rough cuts may be used to provide a general outline of the region to be removed and a series of smoothing or refining cuts such as those that may be obtained using a medium diamond silicone wheel may be used to smooth or refine the carving. When using a diamond silicone wheel, it may be desirable to firmly grip the pearl and move the pearl steadily along the wheel using a delicate touch and little pressure. The carved pearl 10 may then be cleaned, polished and tumbled as is common in the pearl industry.

In another embodiment a laser is used to carve a pearl. A laser may be desired when carving by hand does not provide the detail and precision desired or when a nucleus 11 contains a valuable material such as a diamond or other gem 13 that may be inadvertently scratched by a bladed instrument or by an inexperienced carver. A laser may also provide greater homogeneity among carved pearls 10 when incorporating a programmed instruction such as a computer with installed software. Examples of lasers useable with the present invention may be found within the engraving industry. For example, Engraving Technologies, Inc. offers lasers suitable for use with the present invention. Determining whether a laser is appropriate for carving a pearl may include cutting a nacre coating 12 with the laser and examining the depth of the cut or cuts. When carving with a laser one may refer to the engraving instructions that accompany the laser and adjust the depth of a cut to expose a portion of the nucleus 11. As with the bladed instruments, a single cut may be performed or a series of cuts may be performed.

Cleaning and Polishing

The present invention recognizes cleaning, polishing and tumbling cultured pearls are commonplace in the industry and have related benefits with the present invention. The cleaning, polishing and tumbling processes may be any known to those skilled in the art however methods that may cloud or alter the appearance of the nucleus 11 or the nacre coating 12 may be less desirable. Diamond polishers having silicone wheels are commonplace in the jewelry industry and are useful in the polishing of a carved pearl 10. A variety of polishers are available and provide coarse, fine and high polish. Polishing wheels such as those that incorporate a natural bristle, a synthetic bristle, a brush, a buff and the like may also be useful in cleaning and polishing a carved pearl 10. As a final finish, a buffing wheel may be used with or without a diamond polishing powder.

What is claimed is:

1. A carved pearl comprising:

a) at least two nuclei;

b) a nacre coating comprising a carving;

wherein said carving exposes a portion of said at least two nuclei;

further wherein said carving does not extend entirely through said pearl; and further wherein said at least two nuclei are not exposed except through said carving.

2. The carved pearl according to claim 1, wherein said at least two nuclei are affixed together.

3. The carved pearl according to claim 2, wherein said at least two nuclei are affixed by an adhesive.

4. The carved pearl according to claim 1, wherein at least one of said at least two nuclei is a gem.

5. The carved pearl according to claim 1, wherein said at least two nuclei are gems.

6. The carved pearl according to claim 1, wherein said at least two nuclei have colors that generally correspond to colors of a flag.

7. The carved pearl according to claim 6, wherein said flag is selected from the group consisting of a national flag, a state flag, a province flag, a city flag and a club flag.

8. An article of manufacture comprising:

a) the carved pearl of claim 1 and b) an article of jewelry.

9. The carved pearl according to claim 1, wherein at least one of said at least two nuclei comprises a material selected from the group consisting of a coral, a metal, a metal alloy, a resin, a polymer, a shell powder and a glass.

10. The carved pearl according to claim 1, wherein said at least one nucleus is a gem selected from the group consisting of an agate, an alexandrite, an amber, an ametrine, an amethyst, an aquamarine, an apatile, a beryl, a bloodstone, a chrysoberyl or cat-eye, a citrine, a corundum, a chalcedony, a chysocolla, a coral, a diamond, an emerald, a green beryl, a garnet, a quartz, a lolite, a jadcite, a kupzite, a lapis lazuli, a moonstone, a malachite, a moamite, an onyx, an opal, a peridot, a red corundum, a ruby, a sardonyx, a sapphire, a spessartime, a sphene, a spinel, a star ruby and sapphiren, a sunstone, a tanzanite, a tiger eye, a tourmaline, a topaz, a turquoise, a tsavorite, and a zircon.

11. The carved pearl according to claim 1, wherein at least one of said at least two nuclei is a color different than said nacre coating.

12. The carved pearl according to claim 1, wherein said nucleus further comprises a secondary structure.

13. The carved pearl according to claim 1, wherein said nacre coating is from about 0.2 millimeters thick to about 1.5 millimeters thick.

14. The carved pearl according to claim 1, wherein said carving results from removing a portion of said nacre coating from a fully encased nucleus.

15. The carved pearl according to claim 1, further comprising a dye.

16. An article of manufacture comprising:

a) the carved pearl of claim 1 and b) an article of clothing.

17. A carved pearl comprising:

a) a nucleus comprising a gem selected from the group consisting of an agate, an alexandrite, an amber, an ametrine, an amethyst, an aquamarine, an apatile, a beryl, a bloodstone, a chrysoberyl or cat-eye, a citrine, a corundum, a chalcedony, a chysocolla, a diamond, an emerald, a green beryl, a garnet, a lolite, a jadcite, a kupzite, a lapis lazuli, a moonstone, a malachite, a moamite, an onyx, an opal, a peridot, a red corundum, a ruby, a sardonyx, a sapphire, a spessartime, a sphene, a spinel, a star ruby and sapphiren, a sunstone, a tanzanite, a tiger eye, a tourmaline, a topaz, a turquoise, a tsavorite, and a zircon;

b) a nacre coating deposited on said nucleus, wherein said nacre coating comprises a carving exposing a portion of said gem and further wherein said gem is a different color than said nacre coating.

* * * * *